United States Patent [19]

Furtah et al.

[11] 4,116,389

[45] Sep. 26, 1978

[54] ELECTROMAGNETIC FUEL INJECTION VALVE

[75] Inventors: Reginald D. Furtah, Livonia; Gilbert J. Gardocki, Dearborn Heights, both of Mich.

[73] Assignee: Essex Group, Inc., Fort Wayne, Ind.

[21] Appl. No.: 754,646

[22] Filed: Dec. 27, 1976

[51] Int. Cl.[2] ..... B05B 1/30

[52] U.S. Cl. ..... 239/585

[58] Field of Search ..... 239/585, 533.13; 251/139–141

[56] References Cited

U.S. PATENT DOCUMENTS

| | | | |
|---|---|---|---|
| 1,664,612 | 4/1928 | French | 239/585 |
| 1,892,917 | 1/1933 | Walker et al. | 251/140 |
| 3,241,768 | 3/1966 | Croft | 239/585 X |
| 3,450,353 | 6/1969 | Eckert | 239/585 |
| 3,667,686 | 6/1972 | Garnier | 239/585 |

FOREIGN PATENT DOCUMENTS

| | | | |
|---|---|---|---|
| 2,343,243 | 5/1974 | Fed. Rep. of Germany | 239/585 |

*Primary Examiner*—John J. Love

*Attorney, Agent, or Firm*—Lawrence E. Freiburger; Robert D. Sommer

[57] ABSTRACT

An electromagnetic fuel injection valve which exhibits faster opening and closing times as well as being more linear in flow characteristics than prior art valves. The fuel injector valve of the invention accomplishes these desirdata by providing a combination of design improvements over prior art electromagnetic fuel injector valves. Most notable among the design improvements are: a lighweight plunger, a flat-faced armature, dual adjustment of the valve seat and biasing on the plunger, and a wet coil construction whereby the electromagnetic coil is cooled by fluid flowing through the valve.

1 Claim, 3 Drawing Figures

ELECTROMAGNETIC FUEL INJECTION VALVE

BACKGROUND OF THE INVENTION

With the advent of stringent emission control standards for automobiles has come the need for an efficient, precisely operated fuel supply control system for internal combustion engines. One system under present consideration is the fuel injection system whereby fuel is injected into the intake manifold by an injector valve in accordance with commands from a control circuit. Precise control over the amount of fuel injected and the time it is injected is necessary in order to maintain emissions within certain limits and to operate the engine as efficiently as possible. In the prior art, this precise control was difficult and expensive to attain because prior art injector valves tend to be too slow in opening and exhibit non-linear control characteristics in certain ranges which make their control a more complicated problem. Thus, the need for a fuel injector valve with faster opening and closing times as well as more linear control characteristics is evident.

The fuel injection valves disclosed in U.S. Pat. Nos. 3,450,353; 3,592,392; 3,731,881 and 3,797,756 are typical prior art fuel injection valves. While each of the devices disclosed in these patents makes a definite improvement over prior art devices in opening and/or closing times and/or preciseness of operation, improvement is still needed in these areas. For example, typical prior art valves still exhibit non-linearities within certain operating ranges, thus making accurate control of the valve a difficult task.

In addition, U.S. Pat. No. 3,125,321 discloses a solenoid type valve in which a plunger member carries a valve member which mates with a valve seat to control flow from the inlet to an outlet. The valve disclosed in this patent is not specifically designed for use as a fuel injection valve.

SUMMARY OF THE INVENTION

It is an object of the present invention to overcome deficiencies in prior art fuel injection valves. More specifically, it is an object of the present invention to provide a fuel injection valve in which opening and closing times are faster than prior art injection valves and in which the device is substantially more linear in its operating characteristics than prior art fuel injection valves.

These objects as well as other objects which will become more apparent as the description of the invention proceeds are essentially accomplished by the fuel injector valve of the present invention which includes a low mass lightweight plunger assembly, a wet electromagnetic coil construction in which the electromagnetic coil is cooled by the fluid flowing through the valve, a flat faced armature, adjustments of the valve seat relative to the valve member, and adjustment of the biasing force on the plunger. It has been found that the combination of these features surprisingly decreases the opening and closing times and substantially linearizes the operating characteristics of the fuel injector valve of the invention.

BRIEF DESCRIPTION OF THE DRAWINGS

During the course of the detailed description of the invention reference will be made to the drawings in which.

DETAILED DESCRIPTION OF THE PREFERRED EMBODIMENT OF THE INVENTION

Figure 1:
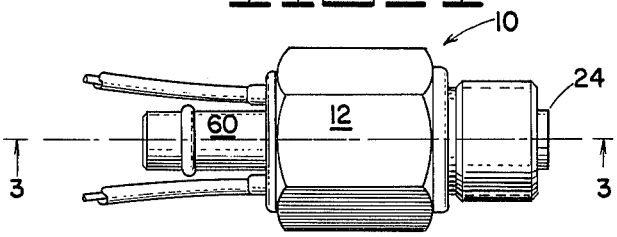
FIG. 1 is an elevational view of a fuel injection valve of the invention.
Figure 3:
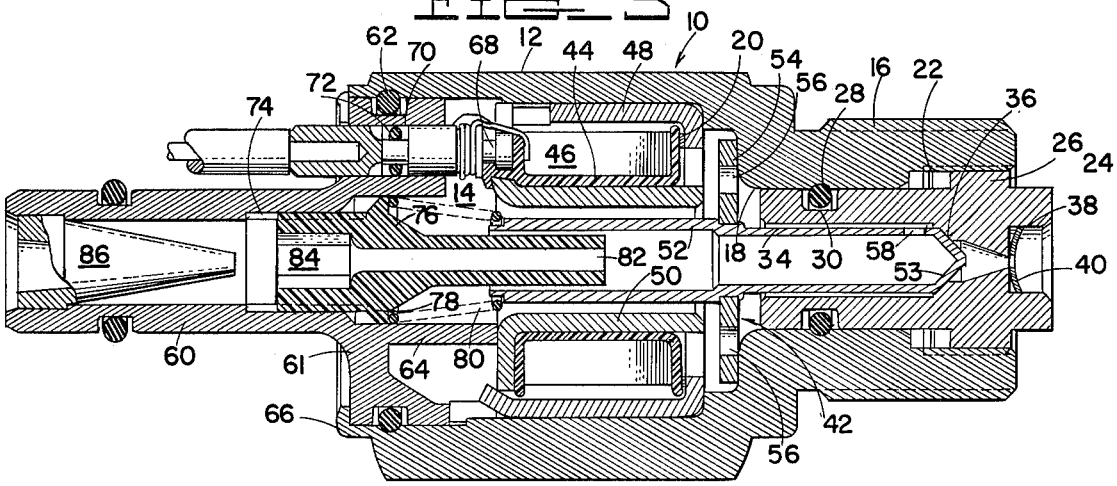
FIG. 3 is a cross sectional view of the fuel injector valve of the invention taken along lines 3—3.

Referring now to the drawing figures and, in particular, FIGS. 1 and 3, there is shown a fuel injector valve in accordance with the present invention. The valve assembly 10 preferably includes a housing 12 which is cast from a suitable lightweight metal such as SAE 309 Aluminum casting alloy. The housing defines a central cavity 14, an end portion 16 which defines an axial bore 18 therethrough. The junction of bore 18 and central cavity 14 is defined by a shoulder 20 formed inside the housing. Bore 18 is counter-bored and threaded at 22 so as to receive certain valve components as will hereinafter be described.

A valve seat assembly includes an adjustable screw member 24 having a threaded collar 6 and an O-ring 28 situated in a circumferential recess 30 so as to prevent the escape of fluid from cavity 14 around the outside of screw member 24. Screw member 24 also includes an axial bore 34 in which a valve seat 36 is formed. The valve seat 36 tapers and leads into a counter-bored recess 38 in the head of screw member 24 which receives a disk-shaped spring member 40 having an orifice therein.

An electromagnetic actuator assembly, generally indicated by reference numeral 42 is also situated within the housing 12. The electromagnetic actuator assembly 42 includes a spool-like bobbin 44 upon which a plurality of turns of magnet type wire 46 is wound. A frame assembly includes a pair of frame members 48 and 50 which are nested together to form a spool-like frame assembly. The electromagnetic actuator assembly also includes a low-mass lightweight non-magnetic plunger member 52 which is adapted for slidable movement in the bore formed by frame member 50 and the bore 34 in screw member 24. Plunger member 52 is preferably formed from aluminum tubing and has its end 53 tapered to cooperate with valve seat 36 to shut off the flow of fluid to the outlet of the valve. A washer shaped armature member 54 is attached to plunger 52 in a collar like manner by staking or other suitable means and is situated between shoulder 54 and the end of the electromagnetic coil assembly. Washed shaped armature 54 has a plurality of apertures 56 therein which allow fluid to flow through the electromagnetic coil 80 as to cool it. In addition, apertures 58 in plunger member 52 allow fluid flow between the interior and exterior of plunger member 52.

Fluid is supplied to the injector valve 10 through an inlet tube 60 constructed of suitable electrically insulating material having a flange 61 which mates with housing 12 to close off the open end of the housing 12. It will be seen that an O-ring 62 effectively seals the interface between inlet tube 60 and housing 12. Inlet tube 60 includes a partial tubular extension 64 which abuts against frame member 50 to locate inlet tube 60 relative to housing 12. To hold the entire assembly together, the end 66 of housing 12 is peened over flange 61. A pair of terminal members 68 are mounted on bobbin 44 and the leads of electromagnetic coil 46 are attached thereto in a suitable manner such as by soldering. It will be seen that the terminal members 68 extend through apertures 70 in flange 61 and the interface therebetween is sealed by an O-ring 72 on each terminal member 68. In addition, the inlet tube 60 has its bore internally threaded at 74 to receive a correspondingly threaded tubular spring adjusting member 76. The spring adjusting member 76 has a collar 78 therearound which forms a seat for a plunger biasing spring 80 which seats against the end of plunger 52 to bias it toward the closed position. Spring adjusting tube 76 includes an axial bore 82 extending therethrough which widens at the inlet end, into a hexagonal portion 84 which is adapted to receive a wrench or other tool inserted into the inlet end of adjusting tube 60 so as to adjust the bias force exerted on plunger member 52 by spring 80. Finally, a filter member 86 of frustoconical shape may be frictionally held inside inlet tube 60.

It is thought that the novel and unobvious aspect of the fuel injection valve of the invention resides in the combination of one or more of the following features in an electromagnetic fuel injection valve:

(1) Adjustment of the valve seat and adjustment of biasing force on the plunger.
(2) Utilization of a wet coil construction whereby the electromagnetic coil is cooled by fluid flowing through the valve.
(3) Use of a low-mass lightweight plunger.
(4) Use of a flat-faced armature.

Figure 2:
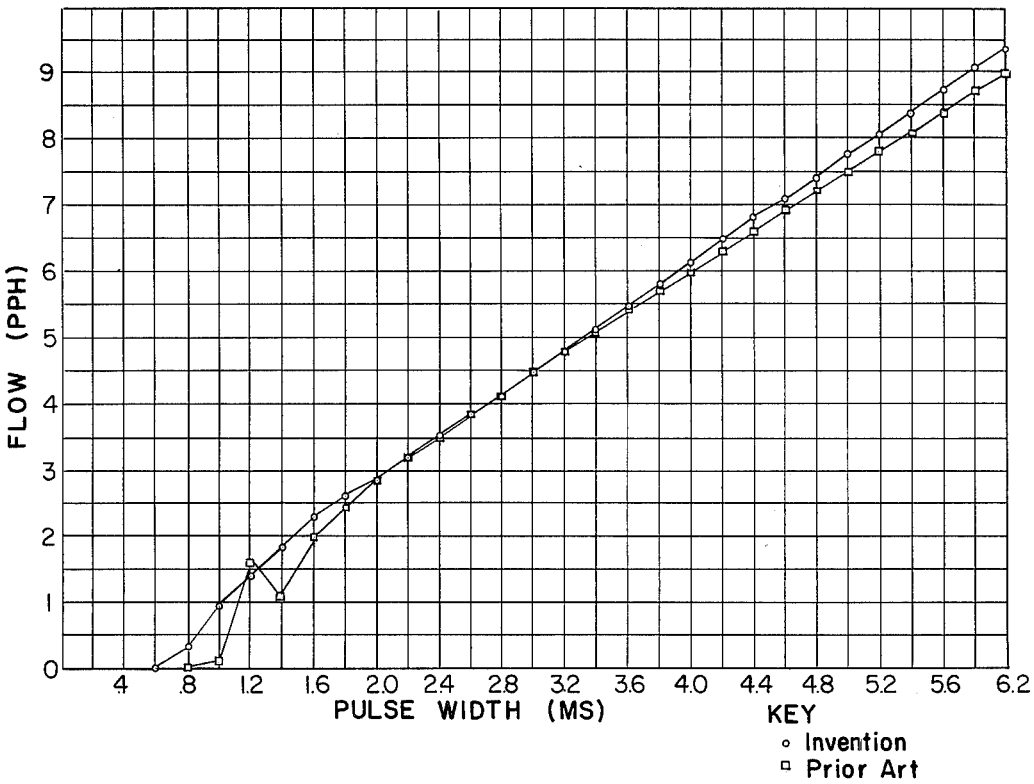
FIG. 2 is a calibration curve comparing the fuel injector valve of the present invention with a typical prior art fuel injector valve.

While prior art valves provide for adjustment of the valve seat or spring biasing force on the plunger, it has been found that both of these adjustments are necessary in order to adjust any single valve for optimum performance. It has also been found that the "wet coil" construction allows maximum utilization of the electromagnetic coil. Further, the lightweight plunger and flat-faced armature substantially reduce the opening and closing times. It has also surprisingly been found that the combination of these features substantially linearizes the operating characteristics of the fuel injection valve. In order to illustrate this reference may be had to FIG. 2 where the flow rate is plotted against pulse width for a fuel injector valve of the invention and a typical prior art fuel injection valve. The measurements were taken at steady state with an input pulse rate of 20 MS. By referring to FIG. 2 it will be observed that the valve of the invention exhibits a substantially linear response whereas the prior art valve is extremely non-linear for inputs having a pulse width between 0.8 MS and 1.6 MS. It should be noted that comparison data on the fuel injection valve of the invention and the prior art valve yields the following values:

| | VALVE OF THE INVENTION | | PRIOR ART VALVE | |
|---|---|---|---|---|
| To | 1.07 | MS | 1.42 | MS |
| Tc | 1.02 | MS | 1.36 | MS |
| FF | 33.44 | PPH | 33.10 | PPH |

Where To (opening time) is defined as the length of time from application of the electrical energy till the valve reaches its fully open position. Similar, Tc (closing time) is defined as the length of time from the deapplication of electrical energy till the valve fully closes and FF (full flow) is the flow rate in pounds per hour which the valve is able to pass when it is fully open.

The features of the invention which are believed to be novel and unobvious have been disclosed in detail. Obvious modifications of the invention will occur to those skilled in the art, and, accordingly, it is intended that the scope of the invention be defined in the Claims.

What is claimed is:

1. An electromagnetic fuel injection valve, comprising:

a non-magnetic tubular housing having an inlet and an outlet at opposite ends of said housing;

an electromagnetic actuator including an electromagnetic coil situated axially inside said housing and an electromagnetic frame associated therewith;

an adjustable valve seat mounted in said housing at said outlet;

a hollow, unitary, tubular, non-magnetic plunger situated for axial movement within the bore of said electromagnetic coil, the end of said plunger being adapted to cooperate with said valve seat to control flow therethrough;

a washer shaped armature attached to said plunger intermediate its ends with said plunger extending axially through said armature, said armature being attracted to said electromagnetic actuator whenever said actuator is energized, there being substantially no magnetic force of attraction between said armature and said electromagnetic actuator other than at right angles to the flat face of said washer shaped armature;

means for causing a fluid flowing between said inlet and outlet to flow around said electromagnetic actuator to cool said coil; and adjustable means for biasing said plunger toward said valve seat.

* * * * *